US007513860B2

(12) United States Patent
Prüm

(10) Patent No.: US 7,513,860 B2
(45) Date of Patent: Apr. 7, 2009

(54) FOLDING APPARATUS FOR COLLECT OPERATION

(75) Inventor: Sebastian Alois Prüm, Kaiserslautern (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 174 days.

(21) Appl. No.: 11/587,150

(22) PCT Filed: Apr. 13, 2005

(86) PCT No.: PCT/EP2005/051634

§ 371 (c)(1),
(2), (4) Date: Oct. 20, 2006

(87) PCT Pub. No.: WO2005/102889

PCT Pub. Date: Nov. 3, 2005

(65) Prior Publication Data

US 2007/0167306 A1 Jul. 19, 2007

(30) Foreign Application Priority Data

Apr. 26, 2004 (DE) ..... 10 2004 020 305

(51) Int. Cl.
*B31F 1/00* (2006.01)

(52) U.S. Cl. ..... 493/432; 493/424

(58) Field of Classification Search ..... 493/419, 493/425, 426, 429, 432, 442, 444, 471, 424, 493/476

See application file for complete search history.

(56) References Cited

U.S. PATENT DOCUMENTS

| | | | | |
|---|---|---|---|---|
| 4,094,499 | A | 6/1978 | Thomas | |
| 4,381,106 | A | 4/1983 | Loebach | |
| 4,892,036 | A | 1/1990 | Lange | |
| 5,000,433 | A | 3/1991 | Prum et al. | |
| 5,287,805 | A | 2/1994 | Fischer et al. | |
| 5,305,993 | A | 4/1994 | Staeb | |
| 5,697,881 | A | 12/1997 | Nishihara | |
| 6,895,858 | B2 * | 5/2005 | Kostiza et al. | 493/424 |
| 2003/0130103 | A1 * | 7/2003 | Fujinuma | 493/432 |

FOREIGN PATENT DOCUMENTS

| | | |
|---|---|---|
| DE | 38 28 372 A1 | 2/1990 |
| EP | 0 098 415 | 1/1984 |

* cited by examiner

*Primary Examiner*—Louis K Huynh
(74) *Attorney, Agent, or Firm*—Jones, Tullar & Cooper, P.C.

(57) ABSTRACT

A folding apparatus includes a folding blade cylinder that carries at least one group of identical tools which are distributed homogeneously about the periphery of the folding blade cylinder. A cam plate is traced or followed by a control lever of each such group of tools and is usable to control a working movement of the tool. A cover disk, consisting of a plurality of cover cams, can be rotated. The cover cams of the cover disk are displaceable between an inactive position, in which they enable the control of the working movement by the cam plate, and an active position in which they prevent such movement. Two groups of tools are used on the folding blade cylinder and the cover cams form a first group of cams at an angular distance of between 60° or 120° to each other, and a second group of cams at an angular distance of between 90° to 180° to each other.

20 Claims, 5 Drawing Sheets

FOLDING APPARATUS FOR COLLECT OPERATION

CROSS-REFERENCE TO RELATED APPLICATIONS

This patent application is the U.S. national phase, under 35 USC 371, of PCT/EP2005/051634, filed Apr. 13, 2005; published as WO 2005/102889 A1 on Nov. 3, 2005 and claiming priority to DE 10 2004 020 305.9, filed Apr. 26, 2004, the disclosures of which are expressly incorporated herein by reference.

FIELD OF THE INVENTION

The present invention is directed to a folding apparatus. The folding apparatus includes at least one folding blade cylinder that has at least one group of tools on its periphery. A cam disk and a cover disk are usable to control movement of the at least one group of tools.

BACKGROUND OF THE INVENTION

A folding apparatus of the general type to which the subject invention is directed comprises a cylinder characterized as a folding blade cylinder or a collect cylinder, which cylinder supports a multitude of holding tools around its periphery that are usable for securing a printed product that is fed to the cylinder and is to be folded. A plurality of folding blades, which extend outward from the interior of the cylinder, engage a printed product, which is held against the cylinder. These folding blades engage the printed product along a predetermined fold line for the printed product, and thereby press it into a folding jaw of a folding jaw cylinder that functions in coordination with the folding blade or collect cylinder. In non-collect operation, each time a printed product passes through the gap between the folding blade cylinder and the folding jaw cylinder, the printed product is released by its holding tool and the subsequent folding blade is extended. During collect operation, a printed product that is held on the folding cylinder passes through the gap at least 2 or n times. During each revolution of the folding cylinder, another printed product is collected on the same peripheral segment of the folding cylinder. Ultimately, printed products, which are collected n times, are pushed together onto the folding jaw cylinder and are thereby folded.

The movement of the holding tools and of the folding blades is generally determined by a control cam, the contour of which control cam is traced by a multitude of cam follower rolls, each of which is coupled to one of the holding tools or to the folding blade.

In a first type of folding apparatus, the control cam is formed by two disks that are mounted coaxially relative to the cylinder, and which are characterized as a cam disk and as a cover disk, which cam disk and cover disk are traced simultaneously by the cam and cover disk follower rolls. The cam disk, which is typically stationary, is equipped with a recessed area, into which a follower roll can dip. When this occurs, the tool that is controlled by the follower roll executes a working movement. In the case of a holding tool, this movement may be, for example, the release of a printed product, or in the case of a folding blade, the working movement may be an extension of the blade.

The cover disk is also equipped with at least one recessed area. This at least one recessed area is positioned during non-collect operation of the folding blade cylinder such that it overlaps the recessed area of the cam disk and thus does not prevent the follower roll from dipping into it. The cover disk can be stationary or can rotate. During collect operation of the folding blade cylinder, the cover disk rotates at a speed that is different from the rotational speed of the cylinder. The recessed areas of the two disks overlap, and the working movement is executed only with every nth revolution of the cylinder. The result is that n collected printed products are then transferred and are folded at the same time.

To achieve the greatest possible flexibility in production, it is desirable to be able to adjust any random value for n, up to an upper limit of $n_{max}$. Since, in order to vary n, in general only the phase position between the cam disk and the cover disk can be adjusted, both $n_{max}$ and the number of possible values for n are relatively small.

To achieve greater variability for collect operation, a folding apparatus has been proposed in DE 38 28 372 A1, in which the cover disk is replaced by a multitude of radially adjustable covering cams. These covering cams make it possible, to a certain extent, to form a cover disk having a circumferential shape that can be adjusted based upon the desired value for n.

With this previously known folding apparatus, eight covering cams are provided, which eight covering cams form two diametrically opposite groups of four each, and which are distributed over an angular interval of 90°. Within a group, the angular distances between the covering cams amount to 30°, 15° and 45°, in sequence. The folding cylinder is comprised of seven parts. With two different rotational speeds for the covering cams relative to the cylinder, production modes in which n=1, 2, 3, 4, or in other words, non-collect, single-collect, double-collect and triple-collect production modes can be realized.

SUMMARY OF THE INVENTION

The object of the present invention is directed to providing a folding apparatus.

The object is attained according to the invention with the provision of a folding apparatus with a folding blade cylinder that has at least one group of identical tools distributed on its periphery. A cam disk is provided for the working movement of the at least one group of tools. The cam disk is traced by a control arm. A cover disk is comprised of a plurality of cover cams which can be rotated with the folding blade cylinder. These cover cams can be moved between active and inactive positions. In the inactive position the cover cams allow movement of the tools. In the active position, they prevent such movement.

The number of tools on the folding blade cylinder of the folding apparatus is only five, rather than the seven tools which is typical of the known folding apparatus. It is possible, while keeping the side length of the product to be processed the same, to decrease the diameter of the folding blade cylinder to five-sevenths of its conventional size. A division of the covering cams into two groups, in which, in the first group, the covering cams have an angular distance from one another of either 60° or 120°, and in the second group the angular distance between the covering cams amounts to 90° or 180°, also enables all modes of production from non-collect to triple-collect.

The folding blade cylinder is preferably equipped with two groups or types of tools, each having equal numbers of tools. One group of tools are holding tools, such as especially sheet end grippers or pin strips, and one group of tools are folding blades.

Each group of tools is expediently assigned its own cam disk and cover disk. Cam disks and cover disks of the different groups can each be arranged on opposite end surfaces of the folding blade cylinder, or alternatively can both be arranged on the same end surface of the folding blade cylinder. With a folding blade cylinder of very wide width, each group of tools can also be assigned to two cam disks and to two cover disks, one of each disks being located on each end surface of the folding blade cylinder.

To enable an adjustment of the folding blade cylinder, to accommodate different numbers of pages of the printed products to be folded, the tools of the first group should have their own cam disks and cover disks on the periphery of the cylinder, which first group cam disks and cover disks are separate from those of the second group.

The number of covering cams in the first group preferably is precisely four, and the angular distance between them amounts alternatingly to 60° or to 120°, in a working position. When all four of these covering cams are active, and with a rotational speed of the cover disk that is 5/6 the rotational speed of the folding blade cylinder, double-collect operation is enabled. During every two cylinder revolutions, the control lever of a particular tool traces an active covering cam, and during the third revolution, it traces the 120° intermediate space between two covering cams of the first group. When two diametrically opposite covering cams of the four covering cams of the first group are active, and the others are inactive, and with a rotational speed of the cover disk that is 5/4 of the rotational speed of the cylinder, single-collect operation is possible, following a phase adjustment, since the covering cam now rotates faster than the folding blade cylinder.

The second group of covering cams preferably comprises precisely three covering cams, which three covering cams accordingly must be arranged at distances of 90°, 90° and 180°, in their working position from one another. When all of these covering cams are active, and with 5/4 the rotational speed of the cover disks relative to the folding blade cylinder, triple-collect operation is possible. When only the two diametrically opposite covering cams of the second group are active, they also enable single-collect operation.

When the second group of covering cams is used, the difference in speed between the cover disk and the folding blade cylinder is greater than it is for the covering cams of the first group. The circumferential length of the covering cams of the second group is also preferably greater than that of the first. Furthermore, with the use of this second group of covering cams, the cover disk system can be adjusted in relation to the folding blade cylinder to accomplish a phase adjustment. With a cover disk speed of 5/6 , the speed of the covering cam is slower than the speed of the folding blade cylinder. However, at a cover disk speed of 5/4 , the speed of the covering cam is faster than that of the folding blade cylinder. This phase adjustment occurs because the cover disk system is rotated, using a differential transmission in the drive train of the cover disk, with respect to the position of the folding blade cylinder for a production shift.

BRIEF DESCRIPTION OF THE DRAWINGS

Preferred embodiments of the present invention are represented in the accompanying set of drawings, and will be described in greater detail below.

The drawings show.

DESCRIPTION OF THE PREFERRED EMBODIMENTS

Figure 1:
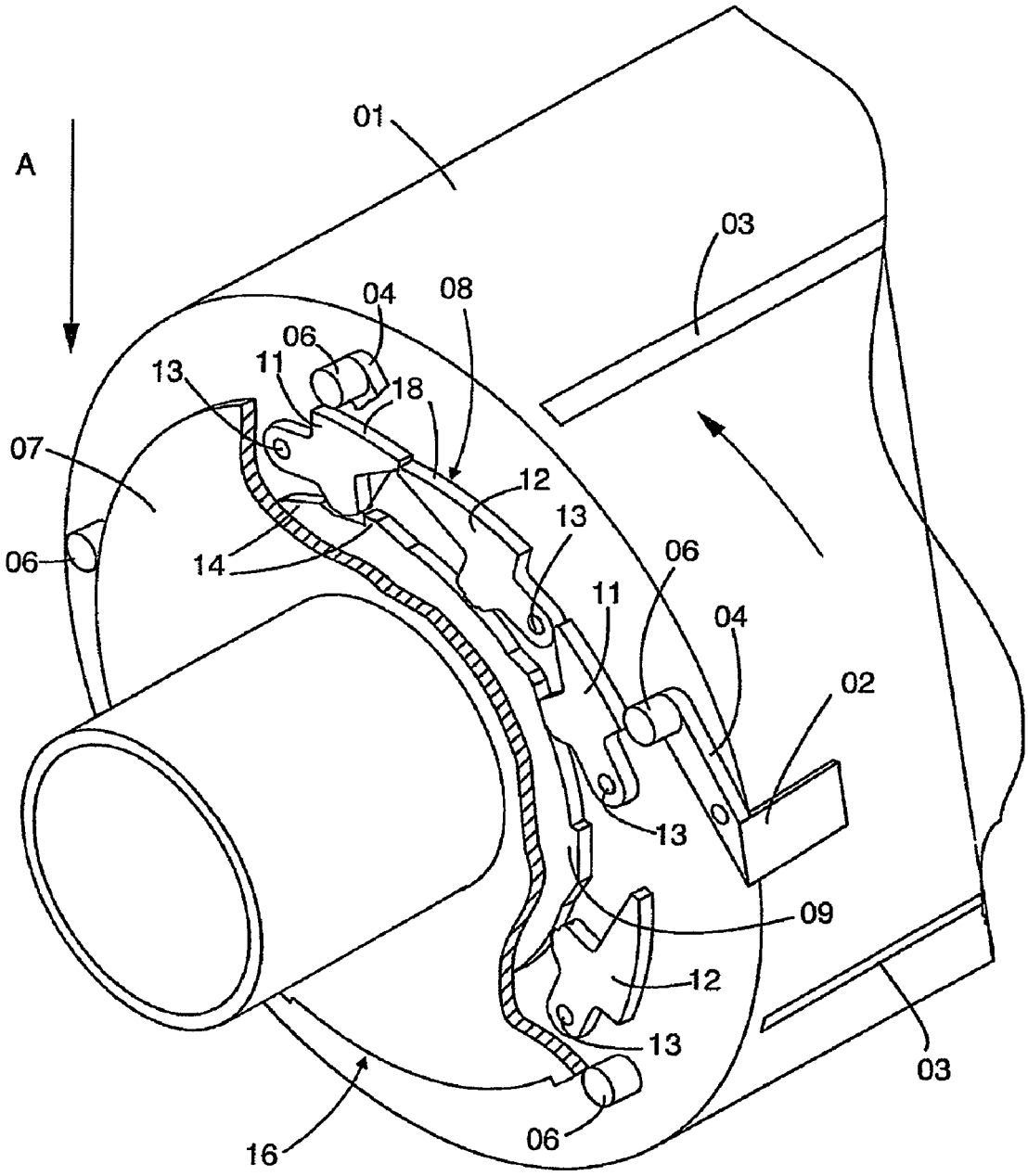
FIG. 1 a perspective partial view of a folding blade cylinder in accordance with the present invention.

FIG. 1 shows a schematic, perspective view of an end area of a cylinder 01, such as, for example a folding blade cylinder 01 for a folding apparatus. The folding apparatus comprises, in addition to the folding blade cylinder 01, a cross cutter, which separates a group of printed material webs that is fed to it, for example paper webs, into single printed products, and a conveyor belt, which accelerates the printed products, that have been separated by the cross cutter, to the circumferential speed of the folding blade cylinder 01. The folding blade cylinder 01 conveys the single printed products on its circumferential surface in the direction of the arrow A. Because the cross cutter and the conveyor belt mechanism are known in the art, and form no part of the present invention, they are not shown in FIG. 1 and will not be described in further detail here.

A circumferential surface of the folding blade cylinder 01 is formed by two groups of five segments each. The segments of the first group each carry a tool 02, such as, for example, a gripper 02 only one of which is partially illustrated in FIG. 1, while the segments of the second group each have a slit 03, out of which slit 03 a folding blade can be extended, in order to allow a printed product, which is held on the folding blade cylinder 01 by the grippers 02, to be introduced into the folding jaw of a folding jaw cylinder, which also is not specifically shown here as it is generally known in the art. The phase positions of the two groups of segments on the periphery of the folding blade cylinder 01 can be adjusted. This can be done in order to adjust the distance between a front or leading edge of a printed product that is held by one of the grippers 02, and the fold that is generated on this printed product, to the length of the printed product.

The movement of each of the grippers 02 is controlled by a control arm or a control lever 04, which carries a cam follower roll 06 at an end of the control lever 04 that faces away from the gripper 02. The cam follower roll 06 is impinged upon by a spring and is forced, by that spring, against the circumference of a stationary cam disk 07, which in FIG. 1 is shown partially cut away. A rotatable cover disk, 08, that is coupled to the folding blade cylinder 01, is arranged between the stationary cam disk 07 and the folding blade cylinder 01.

Figure 2:
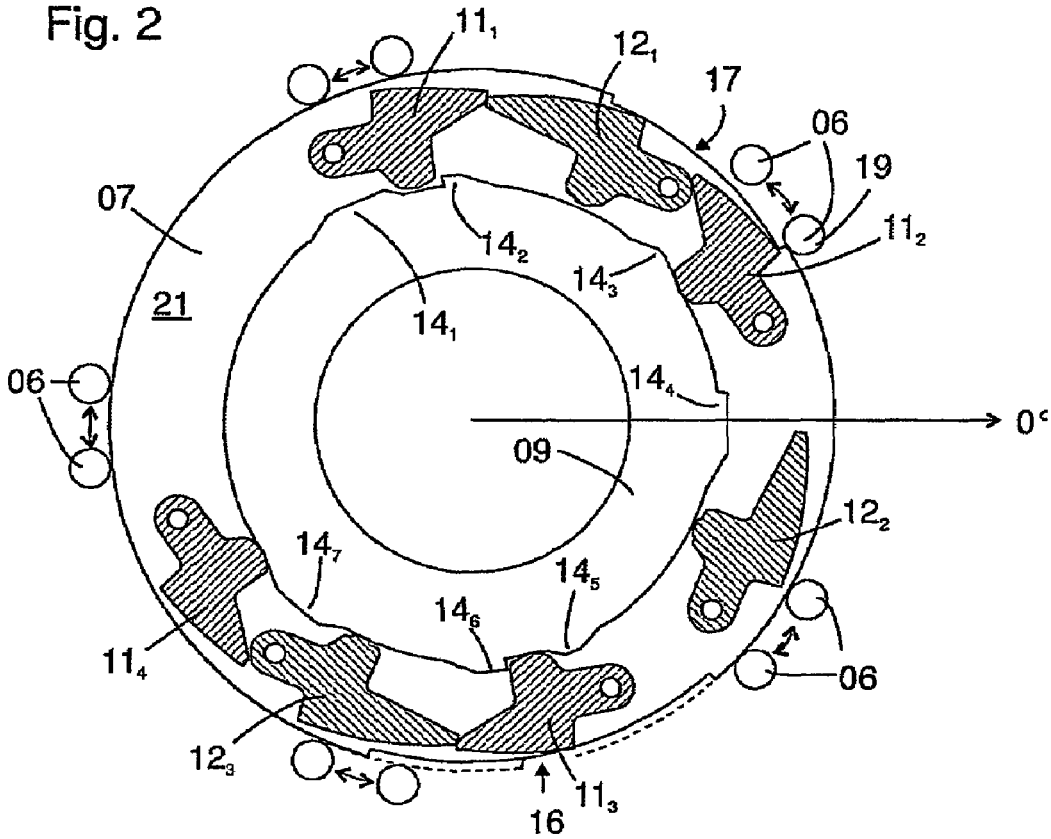
in FIG. 2 a schematic end view of the cam disk and of the cover disk of the cylinder, which control its grippers, in a configuration that corresponds to non-collect operation.

The stationary cam disk 07 has an essentially circular circumference, as can be seen in FIG. 1, and has two recessed areas 16; 17, which are seen more clearly in FIG. 2, and which are characterized respectively as a gripping recess 16 and a release recess 17. The gripping recess 16, when the follower roll 06 of a gripper 02 engages in it, controls an opening and a closing movement of the respective gripper 02, in each case during the acceptance of a new printed product from the conveyor belt. This working sequence of a gripper 02 can never be influenced by the cover disk. In other words, in the area of the gripping recess 16 a follower roll 06 is not rolled over by a covering cam in any production mode. The release recess 17, which is not visible in FIG. 1, in coordination with the gripper cover disk 08, controls the movement of the gripper 02 during the transfer of a printed product to the folding jaw cylinder by the use of a folding blade, which movement and resultant transfer is based upon the desired mode of production of the folding blade cylinder 01. A gripper system and its associated folding blade system are thus controlled in the same rhythm. That means that when the release recess 17 is covered by a covering cam of the gripper cover disk 08, the control recess of the folding blade cam is also covered by a covering cam of the tucker blade cover disk, and vice versa.

The cover disk 08 is comprised of an inner cam ring 09, first and second groups of covering cams 11; 12, respectively, and a frame, which for purposes of clarity is not illustrated here, in which frame the covering cams 11; 12 are held, spring-mounted, with each covering cam being pivotable around an axis 13 and maintained against the outer circumferential surface of the inner cam ring 09. The inner cam ring 09 is capable of rotating relative to the frame, and relative to the covering cams 11; 12, in order to accomplish various configurations for the covering cams 11; 12, in which various configurations, certain ones of the covering cams rest on a cam surface 14 of the inner cam ring 09 or engage the cam ring 09 between two spaced cams or cam surfaces 14. The covering cams 11; 12 each have an arc-shaped outer surface 18, which covering surfaces 18, when a respective covering cam 11; 12 is in its active state, lie at the level of the outer periphery of the stationary cam disk 07, and can thus prevent a follower roll 06 from entering into a recessed area 16; 17 of the cam disk 07.

Figure 8:
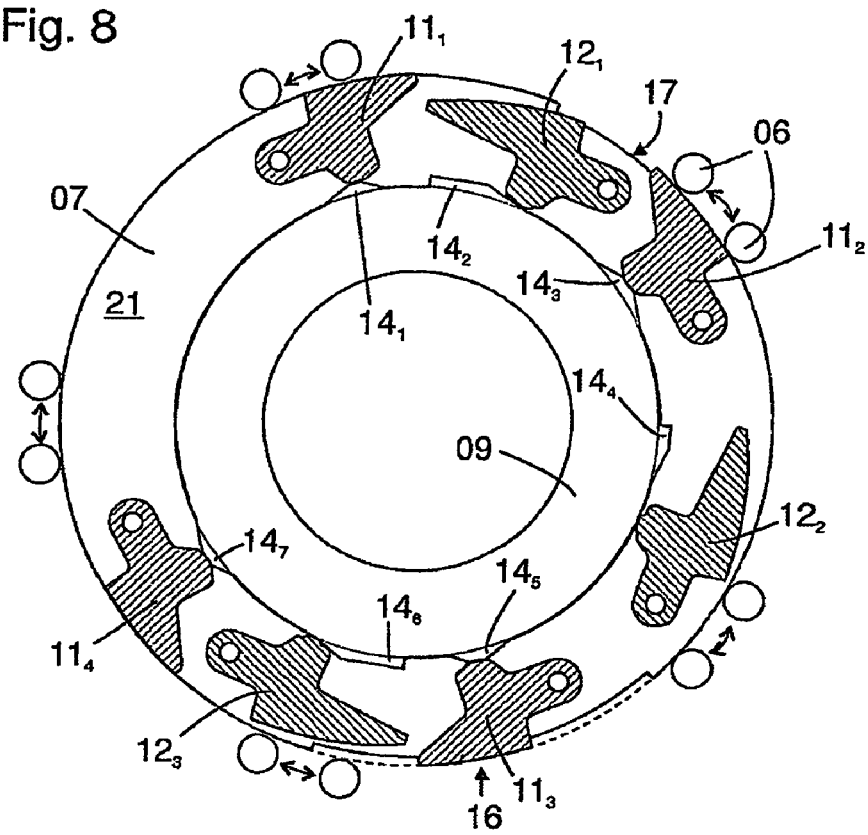

In FIG. 2, an arrangement of the covering cams 11; 12, relative to one another, is more precisely illustrated. Differentiation is made between covering cams $\mathbf{11}_1$ through $\mathbf{11}_4$ of a first group, and each having a comparatively short outer surface 18, which first group 11, through $\mathbf{11}_4$ of covering cams are each arranged at an angular distance of alternatingly 60 or 120° in a working position, as seen in FIG. 8 to one another, and covering cams $\mathbf{12}_1$ through $\mathbf{12}_3$ of a second group, each of whose outer surface 18 is longer, and which each have an angular distance of 90° or 180° from one another, in a working position, as seen in FIG. 8. Two covering cams $\mathbf{12}_1$; $\mathbf{12}_3$ of the second group are arranged in the 60° intermediate space between the respective adjacent covering cams $\mathbf{11}_1$; $\mathbf{11}_2$ or $\mathbf{11}_3$; $\mathbf{11}_4$ of the first group, while the third covering cam $\mathbf{12}_2$ is arranged in the 120° intermediate space between the two covering cams $\mathbf{11}_2$ and $\mathbf{11}_3$. The 120° intermediate space between the respective first group covering cams $\mathbf{11}_4$ and $\mathbf{11}_1$, respectively, is empty.

Pairs of circles, each connected by a double arrow, and depicted on the periphery of the cam disk 07, illustrate the movement play of the follower rolls 06 on the periphery of the cylinder 01 for the purpose of adjustment for different lengths of the printed products to be folded.

In each case, the inner cam ring 09, based upon the indicated 0° direction which is shown in FIG. 2, bears a wide cam surface $\mathbf{14}_1$, between 110° and 125°, a narrow cam surface $\mathbf{14}_2$; $\mathbf{14}_3$ at 95° and 40°, a wide cam surface $\mathbf{14}_4$ between 10° and −15°, narrow cams $\mathbf{14}_5$; $\mathbf{14}_6$ at −65° and −85°, and a wide cam $\mathbf{14}_4$ between −135° and −125°.

In the configuration which is shown in FIG. 2, all of the covering cams $\mathbf{11}_1$; $\mathbf{11}_2$; $\mathbf{11}_3$; $\mathbf{11}_4$; $\mathbf{12}_1$; $\mathbf{12}_2$; $\mathbf{12}_3$ engage in the intermediate spaces between cams $\mathbf{14}_1$ through $\mathbf{14}_7$ of the cam ring 09. Thus, the outer covering surfaces 18 of all of the covering cams are all located within a circle, whose radius corresponds to the radius of the recessed areas 16; 17 of the cam disk 07. None of the covering cams $\mathbf{11}_1$; $\mathbf{11}_2$; $\mathbf{11}_3$; $\mathbf{11}_4$; $\mathbf{12}_1$; $\mathbf{12}_2$; $\mathbf{12}_3$ cover the release recess 17, so that with each revolution of the tucker blade cylinder 01, the printed product that is held by the gripper 02 is released. This corresponds to non-collect operation of the folding blade cylinder 01.

Figure 3:
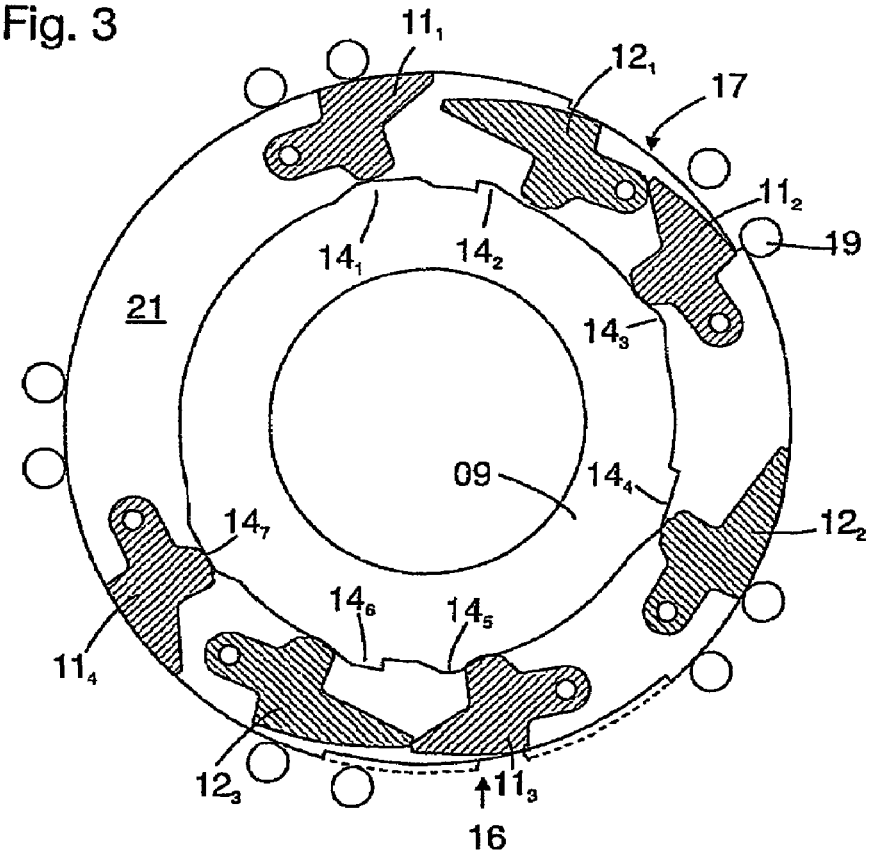
in FIG. 3 a view analogous to that of FIG. 2, in single-collect operation.

In the configuration shown in FIG. 3, the cam ring 09 is rotated clockwise approximately 20° relative to its position of FIG. 2, so that the covering cams $\mathbf{11}_1$; $\mathbf{12}_2$; $\mathbf{11}_4$ rest on a cam $\mathbf{14}_1$; $\mathbf{14}_4$; $\mathbf{14}_7$ of the cam ring 09. In other words, these covering cams are in their active position, in which they are capable of preventing a follower roll 06 from dipping into the release recess 17.

The folding blade cylinder 01 rotates counterclockwise, so that the follower rolls 06 rotate counterclockwise on the stationary cam disk 07. The rotational speed of the cover disk 08 amounts to 5/6 of the rotational speed of the folding blade cylinder 01, so that with each complete revolution of the folding blade cylinder 01, the cover disk 08 falls back or lags the folding blade cylinder 01 by an additional 60°. In the configuration which is shown in FIG. 3, a follower roll, which is indicated by the symbol 19, is positioned at the start of the release recess 17 of the stationary cam disk 07. It is able to dip into the release recess 17, so that a printed product, which is held by one of the folding blade cylinder grippers 02, is now released and can be transferred to the folding jaw cylinder. If, after a complete revolution, the same follower roll 19 again arrives at the release recess 17, it will now run into the covering cam $\mathbf{11}_1$ there, which is now in its active position and which now prevents a release of the printed product. One revolution later, the follower roll 19 encounters the intermediate space 21 between the covering cams $\mathbf{11}_1$ and $\mathbf{11}_4$. It is thus now able to dip into the recess 17, and the printed product is again released. In subsequent revolutions, the follower roll 19 encounters, at the release recess 17, in sequence, the active covering cam $\mathbf{11}_4$, the inactive covering cam $\mathbf{11}_3$, the active covering cam $\mathbf{12}_2$ and finally again the inactive covering cam $\mathbf{11}_2$, at which time, the cycle is completed. With every second revolution, a collected printed product is released. This corresponds to single-collect operation of the folding blade cylinder 01.

Figure 4:
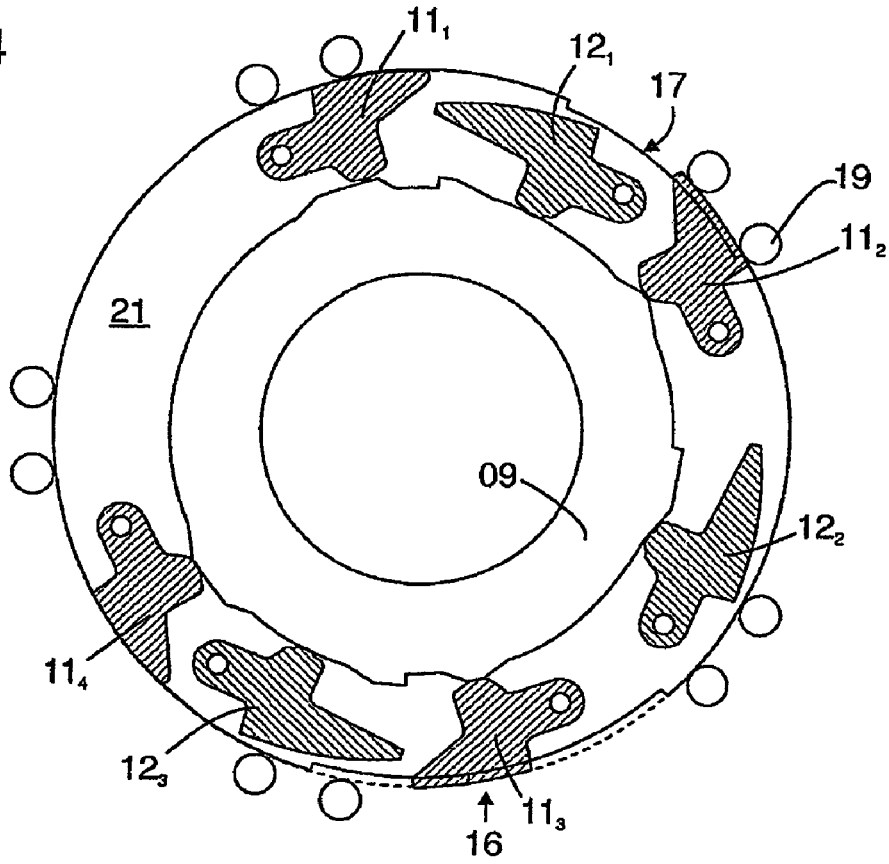
in FIG. 4 a view analogous to that of FIGS. 2, 3 and 4 in double-collect operation.

In the configuration which is shown in FIG. 4, the inner cam ring 09 is turned back approximately 10°, as compared with its location in the configuration of FIG. 3, so that all of the covering cams $\mathbf{11}_1$ through $\mathbf{11}_4$ of the first group of covering cams are in the active position, and the covering cams of the second group of covering cams $\mathbf{12}_1$ through $\mathbf{12}_3$ are in the inactive position. The rotational speed of the cover disk 08 is the same as it was in the case which is shown in FIG. 3. In the configuration shown in FIG. 4, the follower roll 19 encounters the active covering cam $\mathbf{11}_2$, and one revolution later encounters the also active covering cam $\mathbf{11}_1$, after which, it encounters the intermediate space 21 between the covering cams $\mathbf{11}_1$ and $\mathbf{11}_4$ so that the collected product is released. In the next three revolutions the follower roll 19 encounters the active covering cam $\mathbf{11}_4$, the active covering cam $\mathbf{11}_3$ and the inactive covering cam $\mathbf{12}_2$, after which the collected product is again released. This corresponds to double-collect operation of the folding blade cylinder 01.

Figure 5:
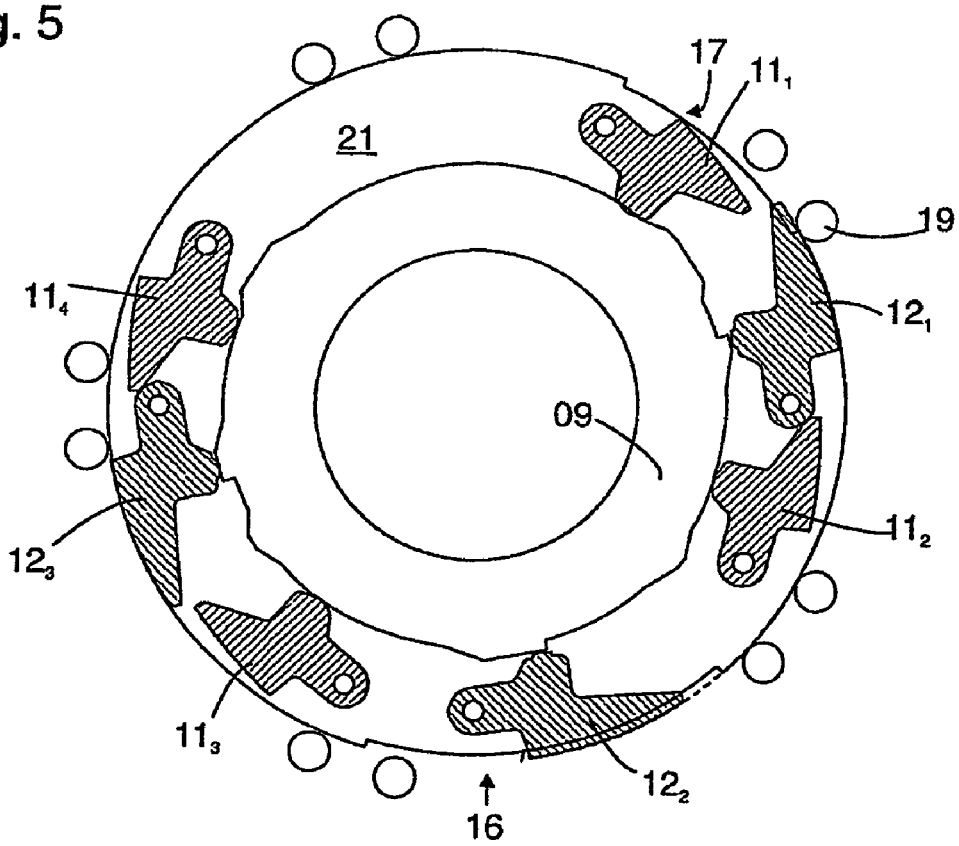
in FIG. 5 a view analogous to that of FIGS. 2, 3 and 4 in triple-collect operation; and in FIG. 6 through 9 views analogous to those of FIG. 2 through 5, in accordance with a second preferred embodiment of the present invention.

In the configuration which is shown in FIG. 5, the cam ring 09 is once again rotated clockwise by 20° relative to the covering cams 11, 12, so that the covering cams $\mathbf{11}_1$ through $\mathbf{11}_4$ of the first group are now all inactive and the covering cams $\mathbf{12}_1$ through $\mathbf{12}_3$ of the second group are now all active. In this configuration, the rotational speed of the cover disk 08 now amounts to 5/4 of the rotational speed of the folding blade cylinder 01. After each revolution of the folding blade cylinder 01, the cover disk 08 has achieved a lead, or an advance of 90° over the folding blade cylinder 01. Furthermore, the phase adjustment of the cover disk 08, relative to the folding blade cylinder 01, is accomplished. In the illustrated configuration of FIG. 5, the covering cam $\mathbf{12}_1$ blocks the follower roll 19 from dipping into the release recess 17, and in the subsequent revolutions, the covering cams $12_2$; $12_3$ perform such a blocking, until finally with the fourth revolution of the folding blade cylinder 01, the follower roll 19 encounters the intermediate space 21 at the recess 17 and releases the collected product. This corresponds to triple-collect operation of the folding blade cylinder 01.

Figure 6:
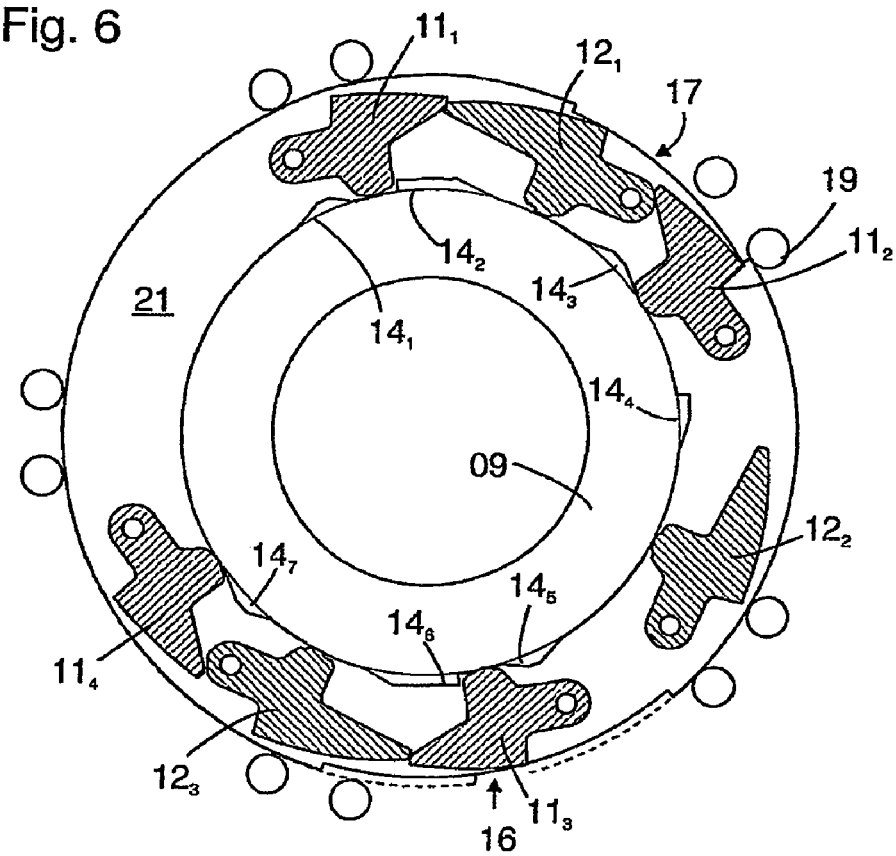

An alternative preferred embodiment for controlling the various modes of collect operation of the folding blade cylinder 01 is represented in FIG. 6 through 9. In this second preferred embodiment, the arrangement and the configuration of the covering cams 11; 12 are the same as in FIG. 1 through 5. Only the distribution of the cams 14 on the inner cam ring 09 in FIG. 6 through 9 is different from that of FIG. 1 through 5. A narrow cam 14, lies at approximately 115°, a wide cam $14_2$ at 95° to 85°, narrow cams $14_3$; $14_4$; $14_5$ at approximately 45°, 5°, −65°, a wide cam at approximately −85° to −95°, and a narrow cam at approximately −135°. In FIG. 6, as in FIG. 2, all of the covering cams $11_1$ through $11_4$, $12_1$ through $12_3$ are inactive, so that collection is not performed.

Figure 7:
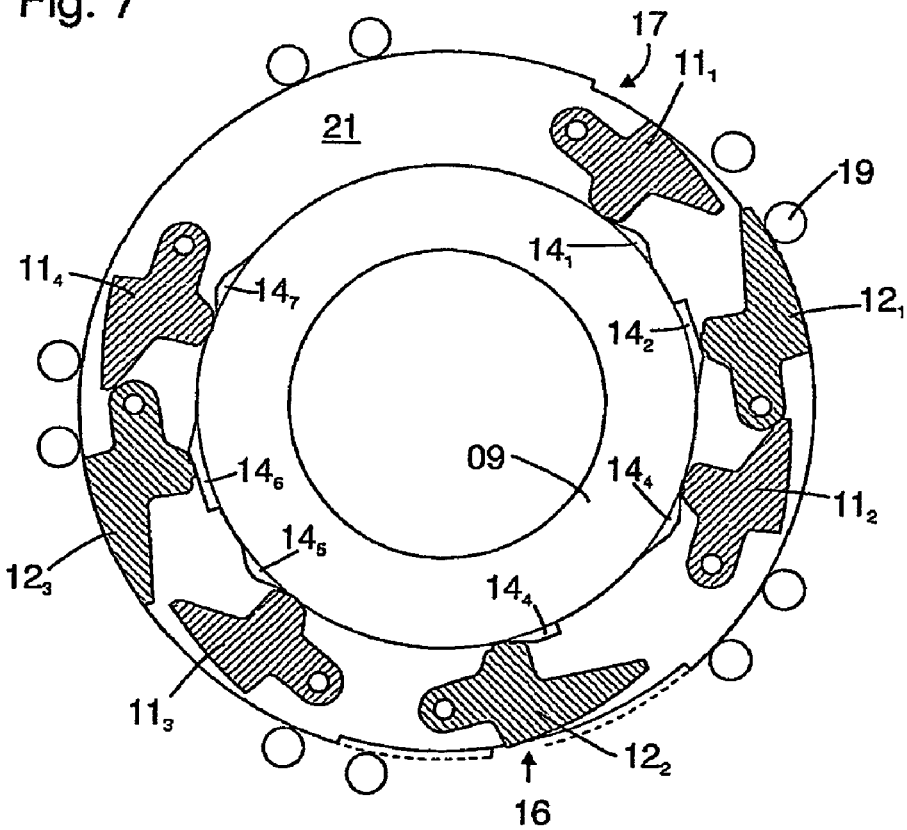

In FIG. 7, only the covering cams $12_1$; $12_3$ are active, and the rotational speed of the cover disk 08 amounts to 5/4 of the rotational speed of the folding blade cylinder 01. In the configuration shown in FIG. 7, the covering cam $12_1$ prevents the follower roll 19 from dipping into the release recess 17. One revolution later, the follower roll 19 encounters the inactive covering cam $12_2$ and releases the printed product. Another revolution later, the follower roll 19 encounters the active covering cam $12_3$, so that collection is now performed. With the subsequent revolution of the cover disk 08, the follower roll 19 encounters the intermediate space 21 and releases.

Figure 9:
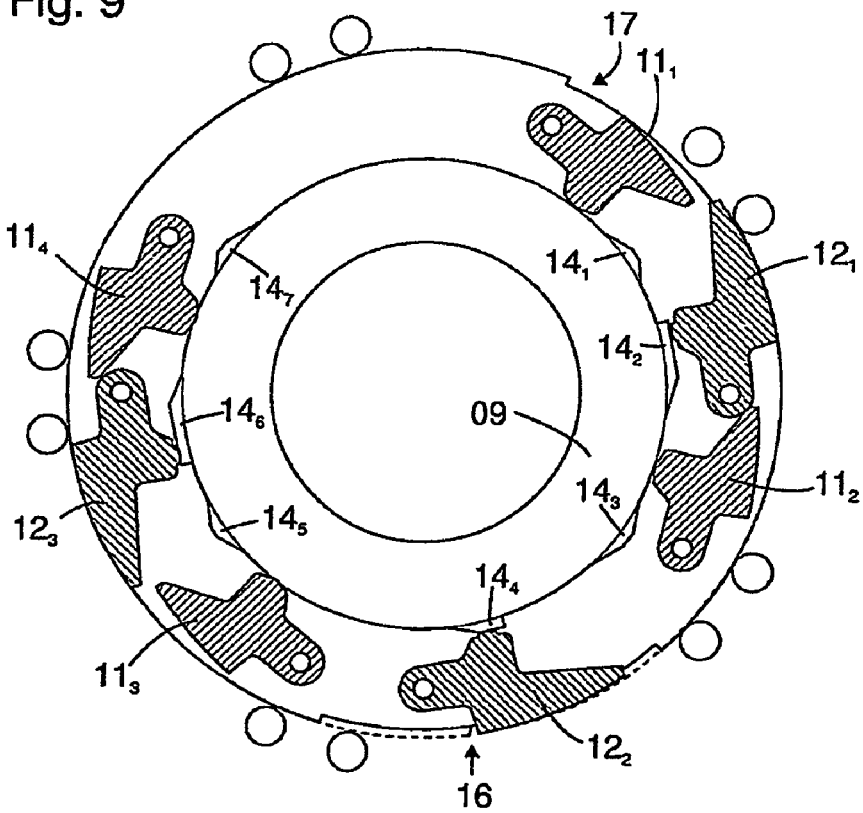

In FIGS. 8 and 9, the positions of the covering cams $11_1$ through $11_4$, and $12_1$ through $12_3$ are the same as was discussed in connection with FIGS. 4 and 5, and the mode of operation is the same.

The construction for the cover disk 08, comprising adjustable covering cams 11; 12, as described above for the control of the grippers 02, can also be used if pin strips are used as the gripping tools. In this case, the construction is simplified slightly, as a cam disk for use in controlling pin strips requires only one release recess 17, and no gripping recess 16.

The same applies to the control of the extension of folding blades from the slits 03 in the folding blade cylinder 01. Here again, the stationary cam disk has only a single recessed area.

Furthermore, this principle can also be used to control a trailing gripper on a folding jaw cylinder 01.

In place of the five grippers 02 or of the pin strips with pins, the folding blades or the folding jaws, the cylinder 01 can also have three or seven sections. In other words the cylinder 01 can have three, five or seven groups of tools 02, especially groups of grippers 02 or of pin strips with pins, or of folding blades or of folding jaws.

In the above-described embodiments, only the grippers 02 are viewed as examples of tools 02 that are mounted on the cylinder 01 and which are periodically actuated. The invention can also be used in the same manner as described above with other periodically moved tools 02, such as folding blades, pin strips with pins, folding jaws, and the like.

While preferred embodiments of a folding apparatus for collect operation, in accordance with the present invention, have been set forth fully and completely hereinabove, it will be apparent to one of skill in the art that various changes in, for example, the overall structure of the printing press, the drive assembly for the folding blade cylinder, and the like could be made without departing from the true spirit and scope of the present invention, which is accordingly to be limited only by the appended claims.

What is claimed is:

1. A folding blade cylinder comprising:

a rotatable cylinder body having a cylinder body periphery;

five groups of tools distributed evenly on said cylinder body periphery, each of said five groups of tools being supported for working movement with respect to said cylinder body periphery;

a separate control arm connected to each of said five groups of tools and usable to effect said working movement of each of said five groups of tools;

a stationary cam disk associated with said cylinder body, said stationary cam disk being operable to control said working movement of each of said five groups of tools, said stationary cam disk being traced by each said separate control arm of each of said five groups of tools;

a rotatable cover disk including multiple covering cams, said rotatable cover disk being selectively rotatable in relation to said rotatable cylinder body, each of said covering cams being selectively movable between an inactive position, in which it prevents said control of said working movement by said stationary cam disk, and an active position in which it permits said control of said working movement by said stationary cam disk;

a first group of said plurality of covering cams and having four of said covering cams each positioned at an angular spacing from an adjacent one of said first group of covering cams of one of 60° and 120°; and a second group of said plurality of covering cams and having three of said covering cams each positioned at an angular spacing from an adjacent one of said second group of covering cams of one of 90° and 180°, each of said second group of covering cams being positioned between two adjacent ones of said first group of covering cams, said first group of covering cams and said second group of covering cams cooperating to adapt said folding blade cylinder for one of non-collect, single-collect, double-collect and triple-collect operation.

2. The folding blade cylinder of claim 1 wherein said tools are selected from sheet grippers, pin strips and folding blades.

3. The folding blade cylinder of claim 2 wherein said five groups of tools include folding blades and sheet grippers, said folding blades being spaced at a non-adjustable circumferential distance from said groups of sheet grippers.

4. The folding blade cylinder of claim 2 wherein said five groups of tools include folding blades and sheet grippers, said folding blades being spaced at an adjustable circumferential distance from said groups of sheet grippers.

5. The folding blade cylinder of claim 1 wherein there are first and second types of said groups of tools, said first type being one of sheet grippers and pin strips, said second type being folding blades.

6. The folding blade cylinder of claim 5 further including a first cam disk and cover disk for said first type of said groups of tools and a second cam disk and cover disk for said second type of said group of tools, said first and second cam disks and cover disks being all located at one end of said cylinder body.

7. The folding blade cylinder of claim 6 further including one of said cam disk and said cover disk on both of first and second end faces of said cylinder body, said first type of group of tools being controlled by said first cam disk and cover disk, said second type of group of tools being controlled by said second cam disk and cover disk.

8. The folding blade cylinder of claim 5 further including two cam disks and cover disk for each of said first and second types of said groups of tools and wherein one of each of said two cam disks and cover disks for each said type of groups of tools is located at first and second end faces of said cylinder body.

9. The folding blade cylinder of claim 5 wherein said first type of group of tools are adjustable with respect to said second type of group of tools on said cylinder body periphery.

10. The folding blade cylinder of claim 1 wherein said rotatable cylinder body has a first speed of rotation and said rotatable cover disk has a second speed of rotation, a ratio of said second speed to said first speed being between 5/6 and 5/4.

11. The folding blade cylinder of claim 1 wherein said first group of covering cams have a first angular extension and said second group of covering cams have a second angular extension, said second angular extension being greater than said first angular extension.

12. The folding blade cylinder of claim 1 wherein all of said covering cams are inactive in said non-collect operation.

13. The folding blade cylinder of claim 1 wherein two of said first group of covering cams which are spaced at 120° are active and the rest of said first group of covering cams are inactive and further wherein a covering cam of said second group of covering cams which is spaced at 120° from said active covering cams of said first group is active while the rest of said second group of covering cams are inactive in said single-collect operation.

14. The folding blade cylinder of claim 1 wherein said first group of covering cams are active and said second group of covering cams are inactive in said double-collect operation.

15. The folding blade cylinder of claim 1 wherein said first group of covering cams are inactive and said second group of covering cams are active in said triple-collect operation.

16. The folding blade cylinder of claim 1 further including a common inner cam ring in engagement with all of said covering cams, said common covering cam disk being rotatable with respect to said cylinder body.

17. The folding blade cylinder of claim 1 wherein in said single collect operation, selected ones of said five groups of tools are extendable from said cylinder body periphery during every second rotation of said cylinder body.

18. The folding blade cylinder of claim 1 wherein in said double collect operation, selected ones of said five groups of tools are extendable from said cylinder body periphery during every third rotation of said cylinder body.

19. The folding blade cylinder of claim 1 wherein in said triple collect operation, selected ones of said five groups of tools are extendable from said cylinder body periphery during every fourth rotation of said cylinder body.

20. The folding blade cylinder of claim 1 wherein said rotatable cylinder body and said rotatable cover disk rotate at a speed ratio with respect to each other and further wherein said rotatable cover disk has a point of operation with respect to said cylinder body, and further including means to vary said speed ratio and to effect a phase adjustment of said point of operation.

* * * * *